US007070303B2

(12) United States Patent
Kassay et al.

(10) Patent No.: US 7,070,303 B2
(45) Date of Patent: Jul. 4, 2006

(54) FLUORESCENT LIGHTING FIXTURES WITH CONTROLLED UPLIGHT CAPABILITY

(76) Inventors: Charles E. Kassay, 9 Long Hill Rd., Smithtown, NY (US) 11787; Suzanne M. Kassay, 9 Long Hill Rd., Smithtown, NY (US) 11787; Marc A. Kassay, 85 Hillside Ave., St. James, NY (US) 11780; John P. Kassay, 6 Sheppard La., Smithtown, NY (US) 11787

( * ) Notice: Subject to any disclaimer, the term of this patent is extended or adjusted under 35 U.S.C. 154(b) by 274 days.

(21) Appl. No.: 10/750,391

(22) Filed: Dec. 31, 2003

(65) Prior Publication Data

US 2005/0146867 A1 Jul. 7, 2005

(51) Int. Cl.
*F21S 4/00* (2006.01)
*F21V 7/00* (2006.01)

(52) U.S. Cl. ..... 362/260; 362/217; 362/297; 362/346

(58) Field of Classification Search ..... 362/260, 362/225, 217, 241, 247, 404, 147, 224, 235, 362/244, 245, 296, 297, 341, 346, 347
See application file for complete search history.

(56) References Cited

U.S. PATENT DOCUMENTS

| | | | | |
|---|---|---|---|---|
| 2,281,377 | A | 4/1942 | Ohm | 240/78 |
| 2,327,230 | A | 8/1943 | Weber | |
| 2,327,231 | A | 8/1943 | Westcott | |
| 2,348,930 | A | 5/1944 | Schepmoes | 240/73 |
| 2,474,308 | A | 6/1949 | Franck | 240/51.11 |
| 2,474,341 | A | 6/1949 | Wince | 240/93 |
| 2,545,058 | A | 3/1951 | Walsh | 240/51.11 |
| 2,619,583 | A * | 11/1952 | Baumgartner | 362/221 |
| 5,523,931 | A | 6/1996 | Kassay et al. | 362/235 |
| 5,528,473 | A | 6/1996 | Kassay et al. | 362/247 |
| 5,806,967 | A | 9/1998 | Scorus et al. | 362/223 |
| 5,988,829 | A | 11/1999 | Holder | 362/217 |
| 6,024,468 | A | 2/2000 | Kassay et al. | 362/260 |
| 6,210,018 | B1 | 4/2001 | Kassay et al. | 362/216 |
| 6,428,183 | B1 | 8/2002 | McAlpin | 362/225 |

* cited by examiner

*Primary Examiner*—Thomas M. Sember
*Assistant Examiner*—Guiyoung Lee
(74) *Attorney, Agent, or Firm*—Alfred M. Walker

(57) ABSTRACT

A fluorescent light fixture includes a housing having an elongated horizontal top surface with side edges and edges at opposite ends of the top surface. Oblique walls extend from the side edges of the top surface, and flare downwardly and outwardly from the side edges. The end walls extend downwardly from the top surface, the oblique and end walls joining to form a downwardly facing opening in the housing. A plurality of generally downwardly facing reflectors within the housing extend the length thereof. Fluorescent light bulbs are mounted parallel to each other in the housing beneath the reflectors, so that light from the light bulbs reaching the reflectors is reflected generally downwardly. The oblique walls and an end reflector are configured to direct a portion of light from one or more light bulbs under each end reflector in a generally upwardly direction to provide indirect lighting.

17 Claims, 6 Drawing Sheets

FLUORESCENT LIGHTING FIXTURES WITH CONTROLLED UPLIGHT CAPABILITY

FIELD OF THE INVENTION

The present invention relates indoor lighting with controlled uplight capability.

BACKGROUND OF THE INVENTION

In order to make a large area visually comfortable, downlight fixtures often include some uptight capabilities, to reduce the "cave" effect caused by ceiling fixtures being too intense for the viewer to see the ceiling beyond the fixtures. The cave effect causes a glare-filled, enclosed effect, which increases eyestrain.

However, too much uplighting is inefficient and wasteful, not reflecting a large portion of emitted light back to the space below the fixture.

To provide uptight, it is known to have an open top, which wastes light usage, as much of the light is not reflected back to the space below the fixture. In addition, in general, however, lamp fixtures with open tops have a susceptibility to dirt accumulation.

Among related patents include U.S. Pat. No. 2,281,377 of Ohm, which has a slanted transparent/translucent wall but no reflector, which does not control uplight to a preferable maximum of 5–19% (by bent and concave angles of the reflector). Ohm's wall 13 is convex, so most light is not controlled. If a fixture were made similar to that of Ohm '377, wherein it would be fabricated without the lens, the fluorescent lamps would extend beyond the plane of the side of the fixture, allowing for excessive dirt accumulation thereon. Furthermore, if one would make a fixture similar to that of Ohm '377 with a non-translucent wall, the fixture efficiency would be greatly diminished. In addition, the lack of a photometrically designed reflector would diminish the obtainable efficiency of the fixture.

U.S. Pat. No. 2,534,182 of Schwartz has different angles for reflectors 31, 32, 33 that don't control uplighting. Their rounded lenses are not as efficient as using a flat lens.

In U.S. Pat. No. 2,548,500 of Sachs, the position of the reflector 15 beneath the fluorescent lamp tubes causes 50% of light up and 50% down, not a preferable controlled 5–19% as uptight. Also, if one removes the item 15 of Sachs, one accumulates dirt within the fixture.

U.S. Pat. No. 6,428,183B1 of McAlpin gets 100 percent of light up with visual waste and needs extra upper lamps 32,33 with separate mounts. These upper lamps are exposed and subject to dirt accumulation.

U.S. Pat. No. 5,806,967 of Soorus is mainly a V-shaped uptight fixture open at top, so dirt will invariably accumulate therein.

U.S. Pat. No. 2,545,058 of Walsh has an open top with susceptibility to dirt accumulation. Walsh is mainly uptight only as in FIG. 10 therein.

U.S. Pat. No. 2,474,341 of Wince doesn't have a reflector.

U.S. Pat. No. 2,348,930 of Shepmoes has a V-shape end view configuration of lamp fixtures. Downward light is less than 70%.

U.S. Pat. No. 2,327,230 of Weber is only concerned with access removal of the lens portion 27. Lighting inefficiency is similar to Shepnoes.

U.S. Pat. No. 2,320,829 of Naysmith and U.S. Pat. No. 2,323,002 of Baker both describe V-shaped arrangement of lamps, which does not control uplight.

Therefore, there is a need to provide a fluorescent lamp fixture which controls uptight to a desirable level, without wasting excess light, while significantly reducing an undesirable cave effect and without the tendency to accumulate dirt within the fixture.

OBJECTS OF THE INVENTION

It is therefore an object of the present invention to provide a fluorescent lamp fixture which controls uptight to a desirable level, without wasting excess light, while significantly reduces an undesirable cave effect and without the tendency to accumulate dirt within the fixture.

SUMMARY OF THE INVENTION

In keeping with these objects and others, which may become apparent, the fixtures of this invention accommodate straight fluorescent tube lamps of a variety of lengths and electrical design, for example popular four foot sizes. These fixtures have a full upper housing protecting all lamps from the accumulation of dust and debris while providing a controlled amount (5 to 19%) of total light output to uplighting, thereby lighting ceiling and wall areas above the fixture, to negate the so-called "cave effect". The percentage range of 5 to 19 percent of total uplighting is controlled relative to the quantity of lamps utilized, the angle of the reflector and the height of the outside section of the fixture, which also impacts the angle of the outboard reflector.

The fixtures of this invention have a central section (from an end view) aimed directly below the fixture with lamp or lamps within a concave reflector or reflectors. Wing sections at an oblique angle extend sideways from the central section, carrying their own lamps and reflectors with totally or largely open distal ends, thereby accommodating uplighting in a controlled fashion. The uplighting provided is at an oblique angle from the fixture, as contrasted from prior-art fixtures with dedicated uptight lamps, or direct vertical upward lenses or windows, which would reflect uptight directly down from the ceiling surface.

These lighting fixtures preferably incorporate a trapezoidal pendant bracket, which accurately positions the fixture with respect to the pendant pipe and prevents any tendency of the fixture from deviating from orthogonal orientation. However, the pendant bracket of the present invention is usable on any type of suspended light fixture, to stabilize the fixture in place.

In one embodiment the fixture has no lens and the oblique housing sides are shortened to accommodate uplighting. In a second embodiment, a high efficiency lens is used for downlighting. Then the oblique housing sides are fitted with windows also, which are glazed with flat high efficiency lens panels to accommodate uplighting. Each of these embodiments can accommodate a variety of lamp configurations ranging from three to eight fluorescent lamps per fixture.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
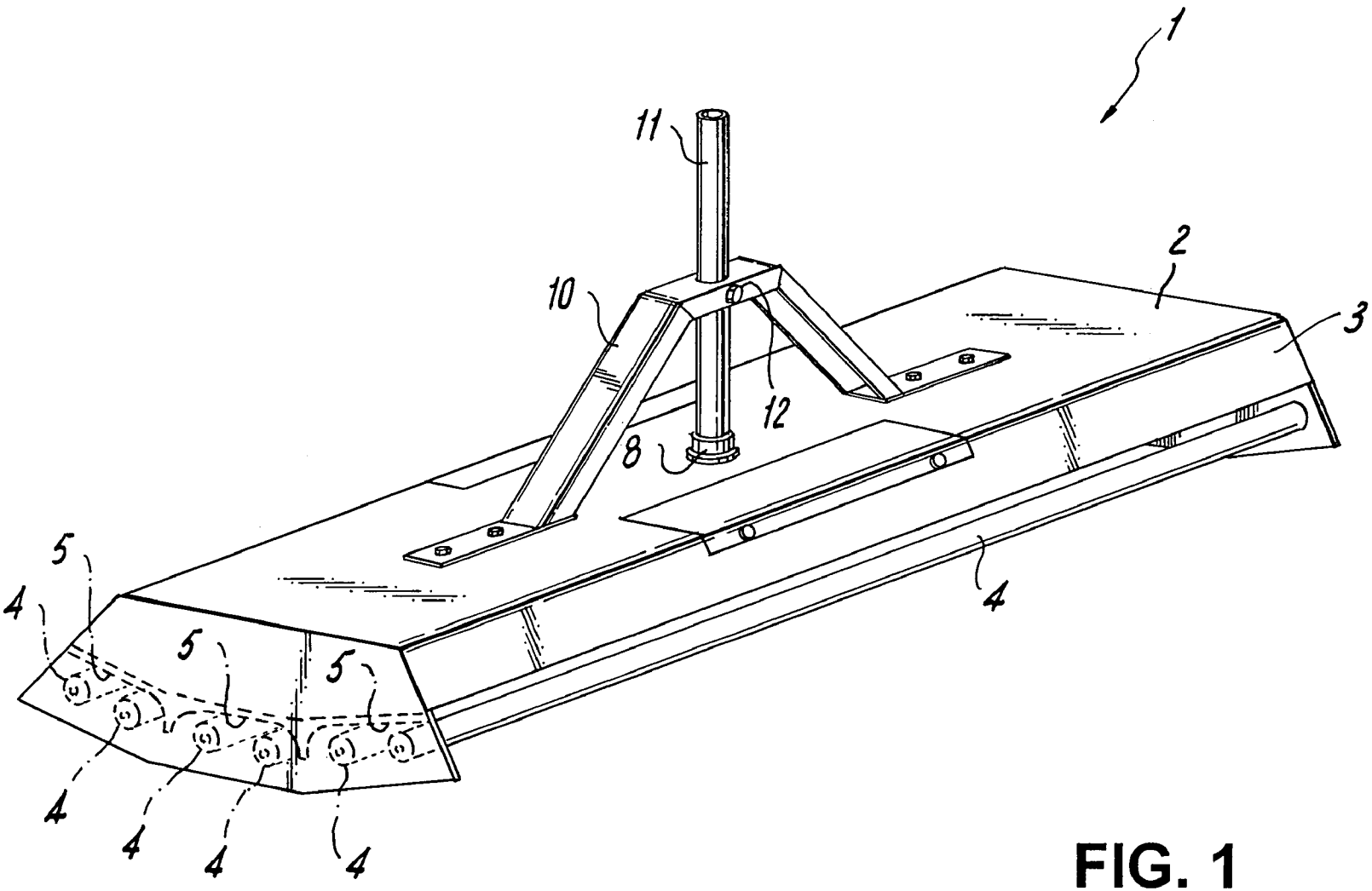
FIG. 1 is a Perspective view of a fluorescent lamp fixture of this invention with no lens.

FIG. 1 shows the first embodiment of this invention, wherein fixture 1 uses no lenses. Fixture 1 has six straight fluorescent tubes 4 within housing 2 with shortened oblique walls 3. Central concave reflector 6 is aimed straight down while side reflectors 5 are angled obliquely and have no curved section (or a very truncated one) at their distal ends. Reflector surface finish can vary, however a white finish, a specular reflector, or an enhanced specular reflector surface with 95% reflectivity are currently offered.

Pendant pipe 11 is used to attach fixture 1 to a ceiling structure; it also carries wiring within. It is mounted in hub 8 and is located accurately by trapezoidal pendant bracket 10 and secured by pendant screw 12. However, pendant bracket 10 is usable on any type of suspended light fixture, to stabilize the fixture in place.

Figure 2:
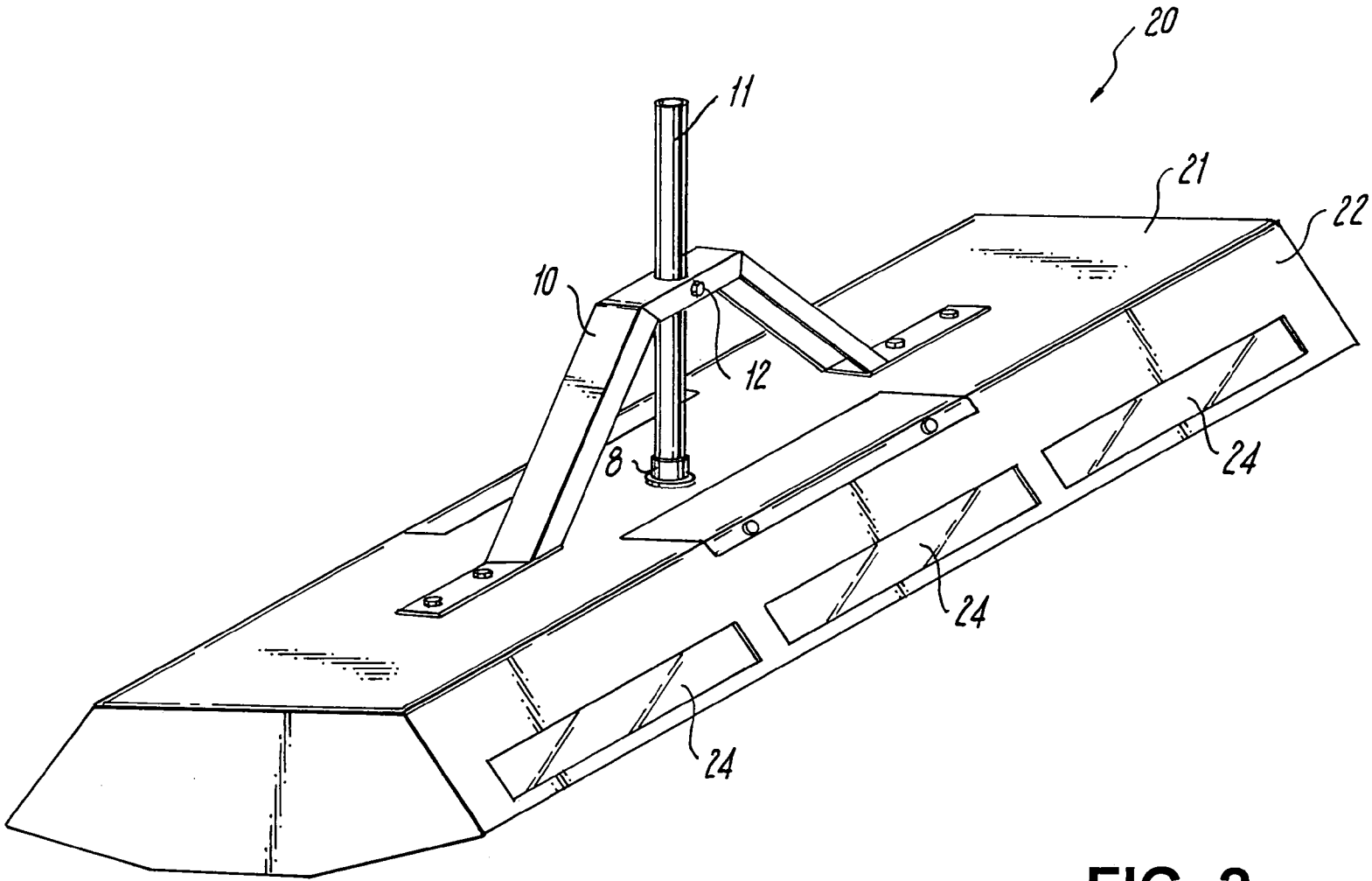
FIG. 2 is a Perspective view of a fluorescent lamp fixture of a second embodiment of this invention incorporating lenses.

In a second embodiment, fixture 20 of FIG. 2 has housing 21 with full oblique walls 22. Walls 22 have three rectangular windows 24 with flat high efficiency lenses to permit a controlled amount of uplighting.

Figure 3:
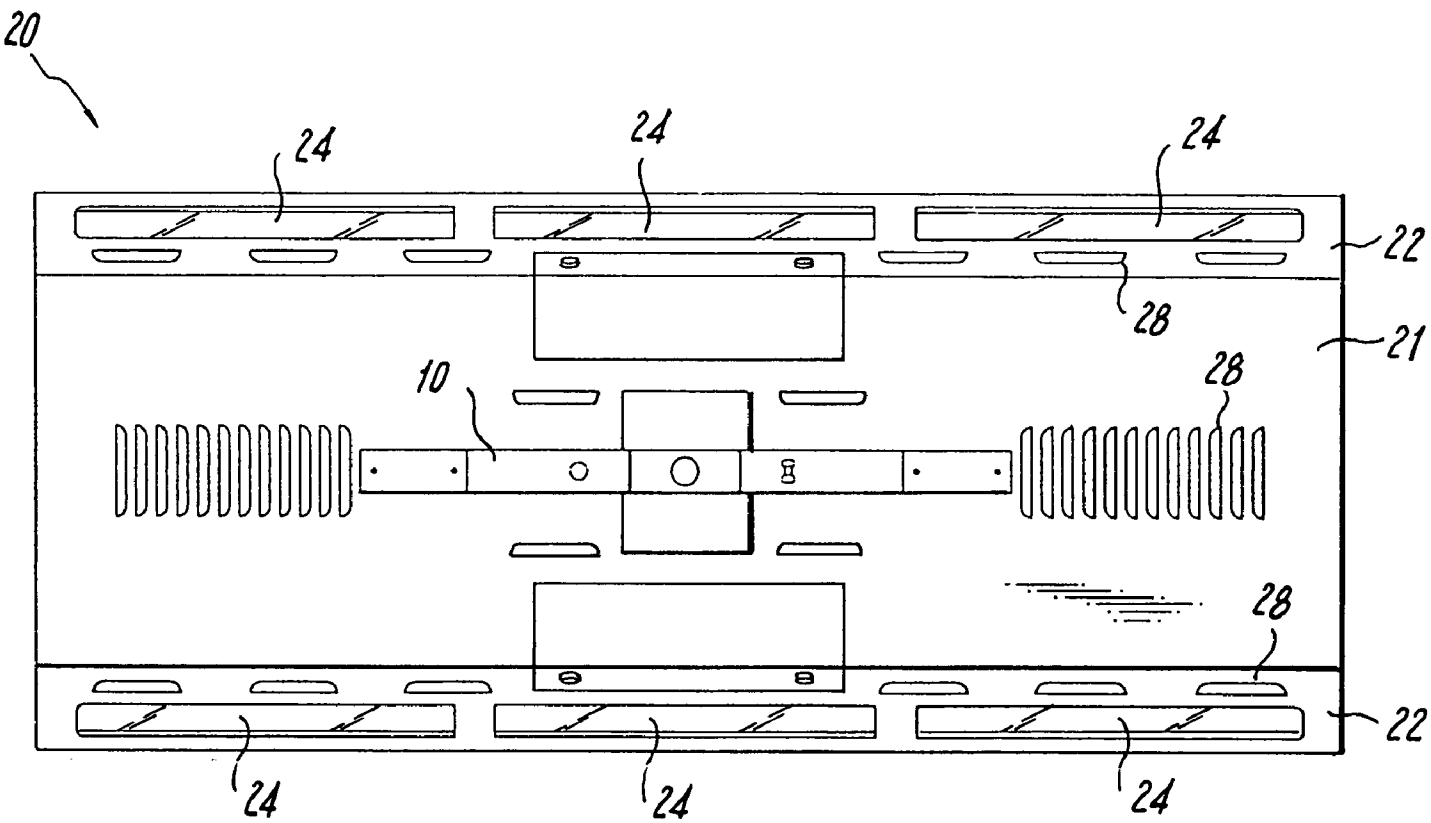
FIG. 3 is a Top plan view of a fluorescent lamp fixture of this invention (shown with lenses)
Figure 4:
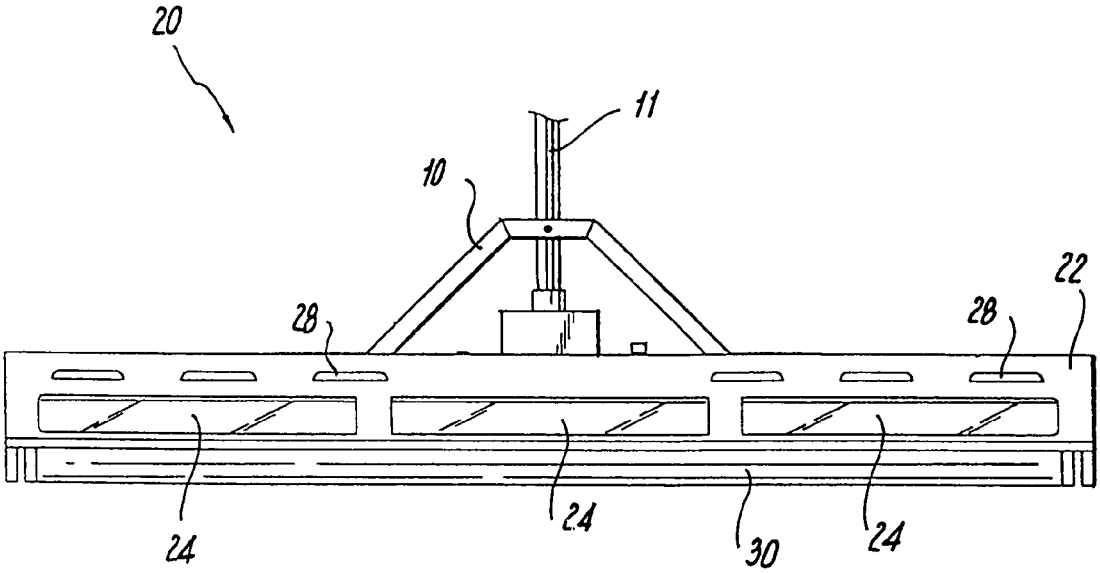
FIG. 4 is a Side elevational view of the fluorescent lamp fixture of FIG. 3.
Figure 5:
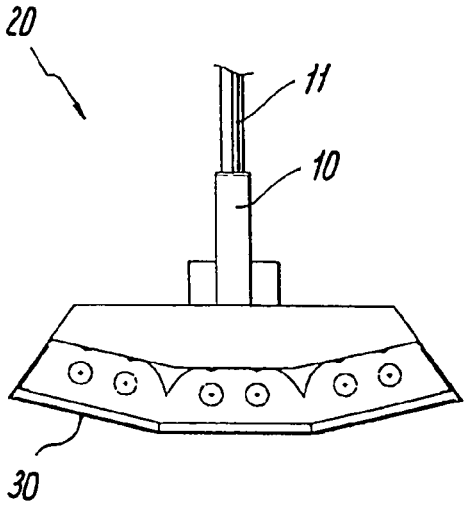
FIG. 5 is an End view of the fluorescent lamp fixture of FIG. 3.

FIGS. 3, 4, and 5 present top, side and end views of fixture 20 respectively. Vent louvers 28 are used to permit air circulation for cooling of ballasts and lamps while excluding dust contamination. High efficiency downlight lens 30 covers the fluorescent tubes.

A variety of lamp configurations for the fixtures of this invention are shown in the end views of FIGS. 6–10.

Figure 6:
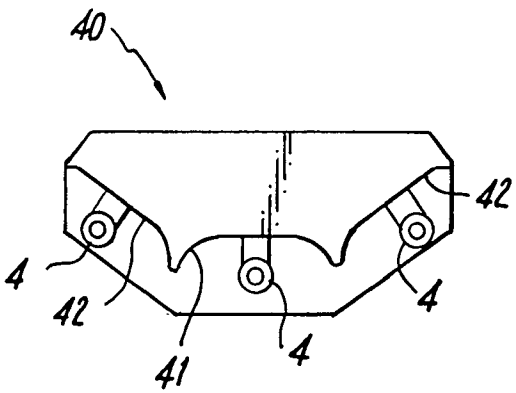
FIG. 6 is an End view of a 3-lamp configuration of a fluorescent lamp fixture of this invention.

For example, FIG. 6 shows a 3-lamp fixture 40 with a single lamp 4 in central reflector 41 and a single lamp in each side reflector 42.

Figure 7:
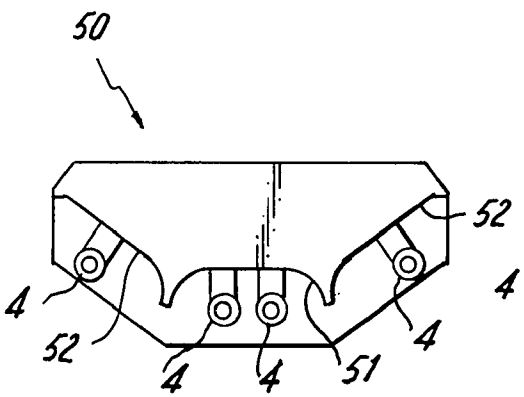
FIG. 7 is an End view of a 4-lamp configuration of a fluorescent lamp fixture of this invention.

FIG. 7 shows a 4-lamp fixture 50 with two lamps within central reflector 51 and single lamps within side reflectors 52.

Figure 8:
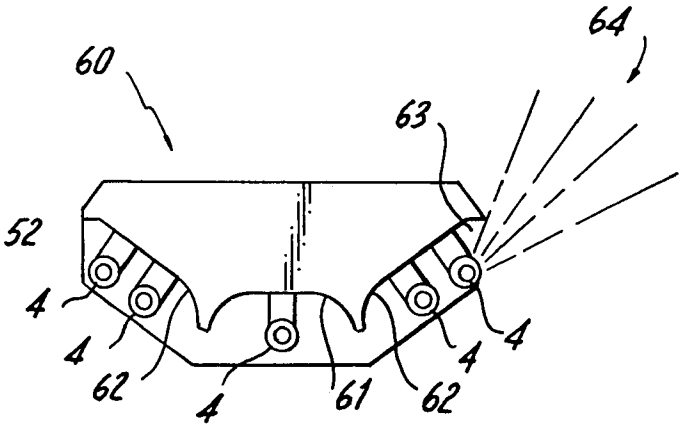
FIG. 8 is an End view of a 5-lamp configuration of a fluorescent lamp fixture of this invention, also indicating geometric features permitting a controlled amount of uplighting.

FIG. 8 shows a 5-lamp configuration 60 with a single lamp in central reflector 61 and two lamps in each side reflector 62. Uplighting rays 64 are shown emanating from right side to illustrate the geometric relationships between the lamp 4 location with respect to reflector 62, truncated end curve 63 and tube 4 surface. Reflector end 63 provides the uptight cut-off and the structural configuration of the reflectors, lamp location, oblique angle, and lamp fixture population permits design of fixtures with uptight percentage fixed as desired, preferably between 5–19% of total.

Figure 5A:
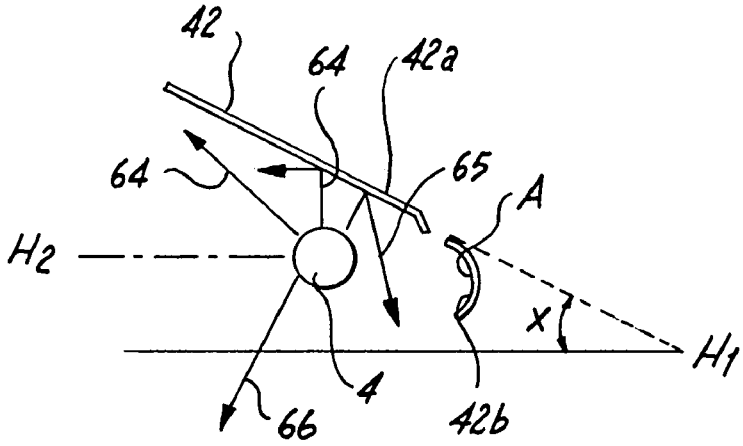
FIG. 5A is a close-up detail side view showing the reflectance of the light rays of fluorescent lamps of the fluorescent lamp fixture of this invention, due to the angle and arc of the reflector having an oblique portion and an arcuate portion.

For example, FIG. 5A shows the reflectance of the light rays 64, 65 and 66 of fluorescent lamps 4 due to the angle X and arc A of the reflector 42. Reflector 42 has a straight oblique portion 42*a* and an arcuate portion 42*b*. A certain portion of rays, emitted from lamp 4 designated as rays 64, are either emitted upward or are reflected off of portions of reflector 42 in an upward direction. Another portion of rays designated as rays 65 are emitted and directed up, but reflected down by either the straight oblique portion 42*a* or the arcuate portion 42*b* of reflector 42. A third portion of rays designated as rays 66 are emitted and directed down. Therefore rays 64 are the only light rays which constitute any uplighting of light from fixture 42. The amount of uplighting is controlled by controlling the angle X of straight oblique portion 42*a* off of imaginary horizontal line H1 and the arc A off arcuate portion 42*b*, off of imaginary horizontal line H1. As a result, a certain percentage of light, such as, for example, 5 to 19 percent, constitutes uplight directed above imaginary horizontal line H2 through the middle of lamp 4, either directly upward from lamp 4 or indirectly upward from lamp 4 via reflector portions 42*a* or 42*b*. The remaining portion of emitted rays are either emitted indirectly downward from lamp 4 below imaginary horizontal line H2 off of the center of lamp 4, via reflector portions 42*a* and/or 42*b*, or directly downward in the form of rays 66 from lamp 4.

Figure 5B:
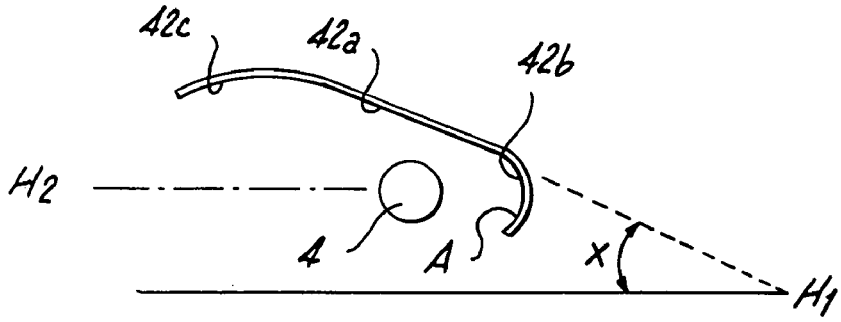
FIG. 5B is a close-up detail side view showing the reflectance of the light rays of fluorescent lamps due to the angle and arc of another embodiment for the reflector having small arcuate concave portion, an oblique portion and an inner arcuate concave portion.

FIG. 5B shows another embodiment of the reflectance of the light rays 64, 65 and 66 of fluorescent lamps 4 due to the angle and arc of the reflector having a first arcuate concave outer portion 42*c*, a second straight oblique portion 42*a* and a third inner arcuate concave portion 42*b*. While the preferable percentage of uplighting is 5 to 19 percent of emitted light reflected above imaginary line H2, that percentage of uplighting can be varied by adjusting the angle of oblique reflector portion 42*a*, inner arcuate concave portion 42*b* and/or outer arcuate concave portion 42*c* of reflector 42.

Besides the differences in the configuration of reflector 42 and in the variations in angle X shown in FIGS. 5A and 5B, the actual size of reflector 42 and its location (i.e. distance from) relative to lamp 4 also have a bearing on the percentage of uplighting.

Figure 10:
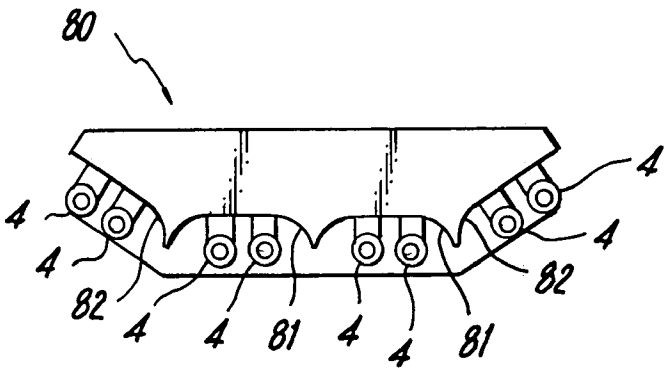
Figure 9:
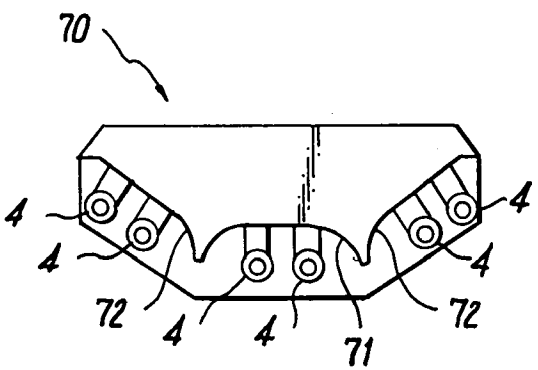
FIG. 9 is an End view of a 6-lamp configuration of a fluorescent lamp fixture of this invention; and, FIG. 10 is an End view of an 8-lamp configuration of a fluorescent lamp fixture of this invention.

FIG. 9 shows a 6-lamp design 70 with two lamps in central reflector 71 as well as in each of two side reflectors 72. FIG. 10 shows an 8-lamp fixture 80 with two down reflectors 81 in the central section with two lamps each. Oblique side reflectors 82 also have two lamps each.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

We claim:

1. A fluorescent light fixture comprising:

a housing having an elongated horizontal top surface with side edges along an elongated length of said top surface and edges at opposite ends of said top surface;

oblique walls having flat surfaces extending from the side edges of said top surface, said oblique walls flaring downwardly and outwardly from said side edges;

end walls extending downwardly from the edges at the opposite ends of said top surface, said oblique and end walls joining to form a downwardly facing opening in said housing;

a plurality of generally downwardly facing reflectors within said housing extending the length of said housing;

fluoresce light bulbs mounted parallel to each other in said housing beneath said reflectors so that light from said light bulbs reaching said reflectors is reflected generally downwardly including central light bulbs and side light bulbs adjacent said oblique walls;

end reflectors behind said side light bulbs each having a straight oblique portion and an outer edge overlapping an end light bulb in said side light bulbs;

said oblique walls being foreshortened to allow a portion of light from a light bulb under said end reflector to be directed in a generally upwardly direction to provide indirect lighting; and a separate end reflector spaced from said outer edge of each oblique end reflector having a concave surface facing said light bulb under each end reflector.

2. The fluorescent light fixture of claim 1 in which said reflectors have concave portions.

3. The fluorescent light fixture of claim 2 in which said reflectors have concave sides and a flat section joining said concave sides.

4. The fluorescent light fixture of claim 2 in which said reflectors have an inner concave sides and an outer slanted oblique flat section.

5. The fluorescent light fixture of claim 3 in which end reflectors are facing concavely, outwardly and downwardly with a straight reflector between said end reflectors facing downwardly.

6. The fluorescent light fixture of claim 5 in which each said adjacent oblique wall and each said concave section includes means to allow some light from the light bulb under said end reflector to be directed upwardly from said light bulbs, said light bulbs being located under and within respective outermost edges of said fixture.

7. The fluorescent light fixture of claim 3 in which an angle between a flat section of each end reflector and a horizontal surface influences how much light is directed upwardly.

8. The fluorescent light fixture of claim 1 in which each said oblique wall terminates in an outer concave section short of a bottom edge of said end walls to allow said some light from the light bulb under said end reflector to be directed upwardly.

9. The fluorescent light fixture of claim 1 in which each said adjacent oblique wall has openings to allow some light from the light bulb under said end reflector to be directed upwardly.

10. The fluorescent light fixture of claim 9 in which at least one transparent lens covers each said opening.

11. The fluorescent light fixture of claim 9 in which at east one semitranslucent lens covers each said opening.

12. The fluorescent light fixture of claim 1 in which multiple light bulbs are located under at least some of said reflectors.

13. The fluorescent light fixture of claim 1 in which said housing is suspended from a ceiling.

14. The fluorescent light fixture of claim 13 in which a pendant bracket is employed to suspend said housing.

15. The fluorescent light fixture of claim 14 wherein said pendant bracket comprises a vertically extending support intersected by a longitudinally extending trapezoidal bracket extending longitudinally along a top surface of a fluorescent lamp fixture.

16. The fluorescent light fixture of claim 1 in which the portion of total light directed upwardly is in the range of about 5 to 19 percent.

17. A fluorescent light fixture comprising:

a housing having an elongated horizontal top surface with side edges along an elongated length of said top surface and edges at opposite ends of said top surface;

oblique walls extending from the side edges of said top surface; said oblique walls flaring downwardly and outwardly from said side edges;

end walls extending downwardly from the edges at the opposite ends of said top surface, said oblique and end walls joining to form a downwardly facing opening in said housing;

a plurality of generally downwardly facing reflectors within said housing extending the length of said housing;

fluoresce light bulbs mounted parallel to each other in said housing beneath said reflectors so that light from said light bulbs reaching said reflectors is reflected generally downwardly including central light bulbs and side light bulbs adjacent said oblique walls;

central reflectors behind said central light bulbs;

end reflectors behind said side light bulbs each having a straight oblique portion and an outer edge having a concave surface overlapping and facing an end light bulb in said side light bulbs; and said oblique walls being foreshortened to allow a portion of light from a light bulb under an end reflector to be directed in a generally upwardly direction to provide indirect lighting.

* * * * *